United States Patent [19]

Croteau

[11] Patent Number: 4,630,328

[45] Date of Patent: Dec. 23, 1986

[54] SELF-COMPENSATING SUPPORT ELEMENT AND END CLOSURE THEREFOR

[75] Inventor: Donald W. Croteau, Oxford, Mass.

[73] Assignee: Thermo Electron-Web Systems, Inc., Auburn, Mass.

[21] Appl. No.: 802,693

[22] Filed: Nov. 27, 1985

[51] Int. Cl.[4] ..... G03G 21/00; D21G 3/00

[52] U.S. Cl. ..... 15/257 R; 15/256.51; 29/517; 118/261; 118/652; 355/15

[58] Field of Search ..... 15/256.5, 256.51, 257 R; 101/169, 425; 118/261, 652; 355/15; 29/422, 517

[56] References Cited

U.S. PATENT DOCUMENTS 3,529,315 9/1970 Dunlap et al. ..... 15/256.51

3,711,888 1/1973 Dunlap ..... 15/256.51

3,778,861 12/1973 Goodnow ..... 15/256.51

*Primary Examiner*—Edward L. Roberts

*Attorney, Agent, or Firm*—Thompson, Birch, Gauthier & Samuels

[57] ABSTRACT

For use in a doctor blade holder or the like, a self-compensating support element consisting of a hollow elongated flexible tube filled, except for the end regions thereof, with an incompressible liquid. Pliable inserts are received in the tube end regions, and tubular metal sleeves are swaged onto the tube end regions and the inserts received therein. The tube end regions are thus tightly clamped between the inserts and the thus swaged sleeves to seal against the escape of liquid from the tube ends.

13 Claims, 6 Drawing Figures

SELF-COMPENSATING SUPPORT ELEMENT AND END CLOSURE THEREFOR

BACKGROUND OF THE INVENTION

1. Field of the Invention

This invention relates generally to doctor blade holders of the type which employ self-compensating flexible support elements to load the doctor blades against the surfaces to be doctored, and is concerned in particular with an improvement in such support elements.

2. Description of the Prior Art

Doctor blade holders of the above-mentioned type are now well known to those skilled in the art. See for example U.S. Pat. No. 3,529,315 (Dunlap et al), the disclosure of which is incorporated herein by reference.

The self-compensating support elements employed in such blade holders usually comprise elongated thermoplastic flexible tubes filled with an incompressible liquid, e.g., oil. In order to perform satisfactorily, such tubes must necessarily have special cross-sectional configurations, with strategically arranged external ribs, and with wall portions having non-uniform thicknesses. For example, in a typical tube, the wall thickness will vary circumferentially from a minimum of about 0.16" at the top portion to a maximum of about 0.40" at the base portion.

Conventional end clamps employing metal inserts and externally swaged metal sleeves have been found to be ineffective in sealing the ends of such tubes. This is because the minimum thickness of the tube wall is often insufficient to withstand the pressure needed to form a proper seal between complimentary metal surfaces without rupturing. Also, the varying wall thickness of the tube causes the swaging force to vary correspondingly. Thus, the greater force required to establish a proper seal at the thinnest wall section often exceeds acceptable stress levels at the thicker wall section, thereby ultimately leading to ruptures at the thicker section.

These difficulties have caused those skilled in the art to abandon mechanical seals and to resort instead to heat sealing techniques. Here again, however, the results have been less than satisfactory. A major problem stems from the fact that during a heat sealing operation, the wall thickness near the seal is unavoidably reduced. If the thinnest wall section is overheated, its thickness will be reduced to the point where it can no longer resist rupturing under field conditions, which normally involve temperatures of up to 300° F. and pulsing loads of up to 8 PLI. Overheating is extremely difficult to avoid because the entire cross section of the tube must be brought up to the melt point before a seal can be made. By the time the thicker wall sections are at that point, the thinner wall sections have often been overheated and excessively thinned.

A further problem with heat sealing stems from the fact that oil in the tube will tend to mix with and contaminate the molten tube material. Moreover, because the oil acts as a heat sink, even more heat must be applied to melt the tube, thereby exacerbating the difficulties associated with overheating.

Because of the foregoing problems, heat sealing operations have proven to be extremely time consuming, often taking a skilled operator in excess of one hour to seal both ends of one tube. In addition, heating sealing operations produce unacceptably high scrap losses, and with results that are largely inconsistent.

The heat sealed tube ends and the tapers associated therein are relatively long, usually about 2-½" in length, which considerably reduces the effective working length of the tube. Also, the heat sealed ends are highly susceptible to being damaged by flexing when being pushed during loading into the blade holder.

SUMMARY OF THE INVENTION

The present invention provides an improved self-compensating support element having its ends reliably sealed by novel mechanical clamps. Each clamp consists of a pliable insert received in the tube end, and a tubular metal sleeve which is swaged onto the tube end, thereby tightly clamping the tube wall between the interior surface of the metal sleeve and the exterior surface of the pliable insert.

During the sleeve swaging operation, the pliable insert accommodates circumferential variations in tube wall thickness by undergoing linear expansion. This allows for the creation of an effective seal without further reducing tube wall thickness.

One embodiment of the invention will now be described, by way of example, with reference to the accompanying drawings.

DETAILED DESCRIPTION OF PREFERRED EMBODIMENT

Figure 1:
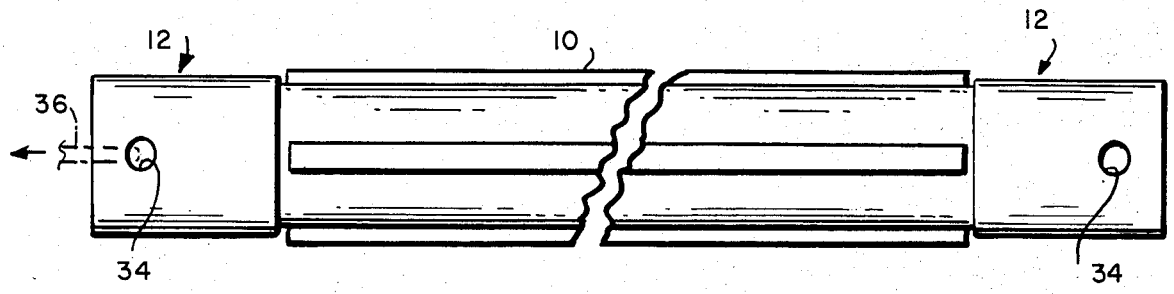
FIG. 1 is a partial top plan view of a self-compensating support element in accordance with the present invention.
Figure 2:
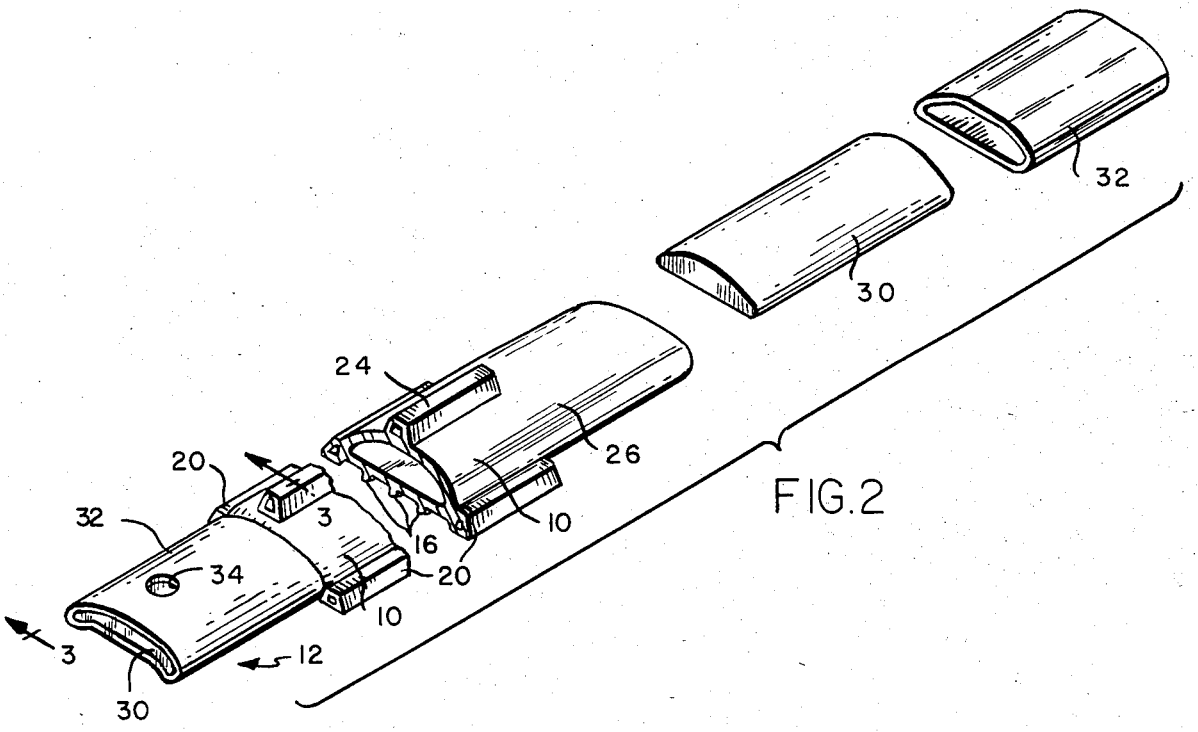
FIG. 2 is a view in perspective showing one end of the support element with the clamp components operatively assembled thereon and showing the opposite end of the support element with the clamp components in an exploded arrangement disassembled therefrom.

Referring now to the drawings, a self-compensating support element in accordance with the present invention is shown comprising an elongated flexible tube 10 having its ends sealed by clamp assemblies 12. The tube may be extruded from a fluoroplastic material, a preferred example of which is TEFLON, a product of Dupont.

Figure 4:
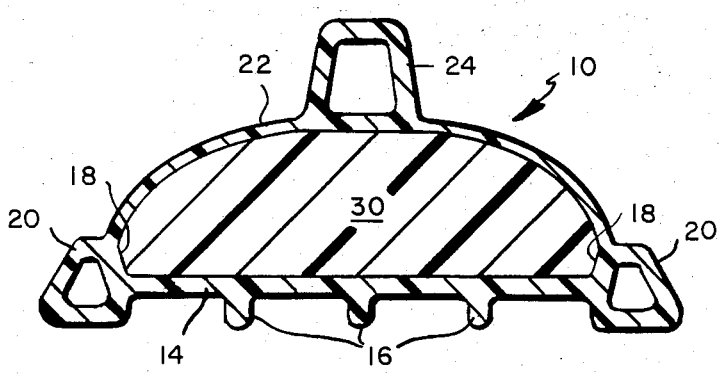

As can best be seen in FIG. 4, the tube has a generally flat base wall portion 14 with downwardly protruding longitudinally extending parallel ribs 16, end wall portions 18 with hollow edges 20, and a somewhat dome-shaped top wall portion 22 with an upwardly protruding centrally located hollow rib 24. The wall portions 14, 18 and 22 have varying thicknesses, with the top wall portion 22 being the thinnest.

The tube, with the exception of its end regions 26 underlying the clamp assemblies 12, is filled with an incompressible liquid 28. The depending ribs 16, hollow edges 20 and hollow rib 24 are trimmed from the end regions 26 to thereby provide relatively smooth and continuous exterior surfaces.

Pliable inserts 30 are received in the end regions 26 of the tube. The inserts are preferably cut from an extruded blank of a compressible and pliable material, a preferred example of which is VITON, a fluoroelastomer sold by Dupont. Metallic sleeves 32 are swaged onto the tube end regions 26 and the inserts. The swaging action causes the end regions of the tube to be tightly gripped between the sleeves 32 and the inserts 30, thereby creating a liquid tight seal which effectively prevents the liquid 28 from escaping from the tube ends.

As the sleeves undergo swaging, the inserts 30 are compressed and expanded longitudinally, without any significant reduction in the extruded thicknesses of the tube wall portions 14, 18 and 22. The inner ends of the inserts protrude inwardly beyond the inner ends of the sleeves to cooperate with the liquid 28 in completely filling the interior of the tube.

Figure 5:
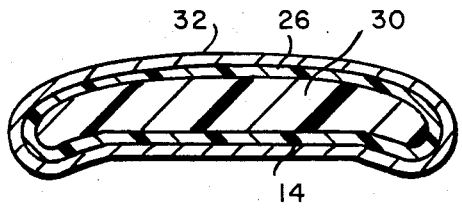
FIGS. 4, 5 and 6 are cross-sectional views taken respectively along lines 4—4, 5—5 and 6—6 of FIG. 3.
Figure 6:
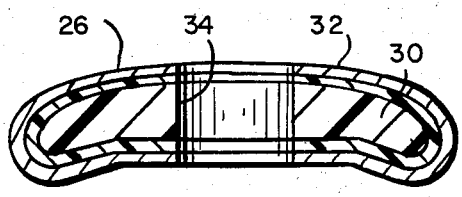
Figure 3:
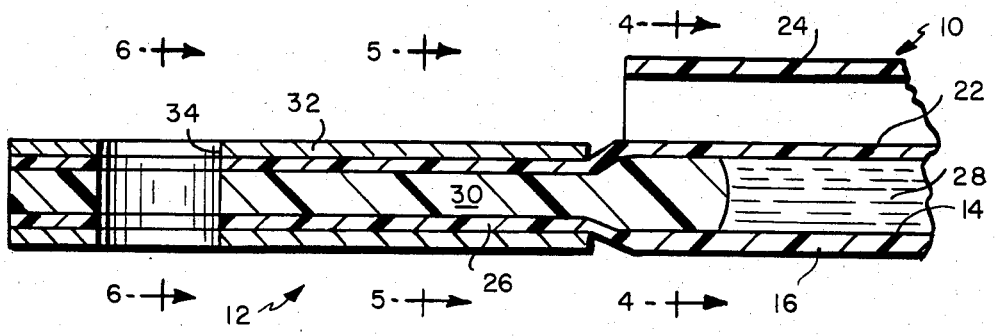
FIG. 3 is a longitudinal sectional view on a greatly enlarged scale taken along line 3—3 of FIG. 2.

The swaging action deforms the base portion of the sleeve 32 inwardly as at 32*a* (see FIGS. 5 and 6) at a location underlying the thicker base portion 14 of the tube wall, i.e., where the tube wall is most resistant to being damaged by localized stresses. Engagement means are provided on the sleeves 32 to facilitate pulling the support element into and out of a doctor blade holder. Such engagement means preferably comprise holes 34 drilled through the sleeves 32 and the inserts 30. As indicated by the broken lines at 36 in FIG. 1, a wire can be inserted through the hole 34 in the sleeve at either end of the element to pull it in either direction.

In light of the foregoing, it will now be appreciated by those skilled in the art that the present invention provides a number of significant advantages as compared with prior art clamping and sealing techniques.

To begin with, the compressibility of the inserts 30 and their ability to undergo longitudinal expansion during swaging of the metal sleeves 32 insures that adequate clamping forces are exerted on the tube to provide an effective seal, without dangerously reducing the tube's wall thickness. Therefor, results are reproducible without undue care and attention on the part of those performing the sealing operation, and scrap losses are considerably minimized. The overall length of the clamped end seal is reduced by about 50% as compared with the conventional heat seals and their associated tapers, thereby increasing the effective working length of the support element. The metal sleeves are less likely to become damaged during handling and installation, and the pull holes 34 provide a convenient means of installing and removing the elements.

I claim:

1. A self-compensating support element for use in a doctor blade holder or the like, comprising: a hollow elongated flexible tube; an incompressible liquid filling said tube except for the end regions thereof; pliable inserts received in said end regions; and tubular metal sleeves surrounding said end regions, said tube being tightly clamped between said sleeves and said inserts to seal against the escape of said liquid from said tube.

2. The support element of claim 1 wherein said metal sleeves are swaged onto the end regions of said tube.

3. The support element of claim 1 wherein said end regions have unequal wall thicknesses.

4. The support element of claim 3 wherein said metal sleeves are swaged onto the end regions of said tube, and said inserts are compressed and expanded longitudinally as a result of said sleeves being swaged, thereby avoiding any reduction in the wall thickness of said tube at said end regions.

5. The support element of claim 3 wherein said sleeves are swaged inwardly at a location adjacent to the area of maximum wall thickness of said end regions.

6. The support element in accordance with any one of the preceding claims wherein said tube is provided with external ribs which extend longitudinally and continuously along the length thereof except at the end regions surrounded by said sleeves.

7. The support element of claim 1 wherein said sleeves have end portions with engagement means associated therewith for coupling with pulling devices employed to install said element in the doctor blade holder.

8. The support element of claim 7 wherein said engagement means comprises holes extending through the outer end portions of said sleeves, said inserts and said tube.

9. The support element of claim 1 wherein said inserts protrude into said tube beyond the inner ends of said sleeves.

10. A self-compensating support element for use in a doctor blade holder or the like, comprising:

a hollow flexible tube provided with external ribs which extend continuously and longitudinally along said tube except at the end regions thereof, at least said end regions having bottom, end and top wall portions of unequal thickness;

an incompressible liquid filling said tube except for the end regions thereof;

pliable inserts received in said end regions; and tubular metal sleeves swaged onto the end regions of said tube and said inserts, said tube being tightly clamped between said sleeves and said inserts to seal against the escape of liquid from said tube.

11. An end closure for an elongated flexible support tube of the type adapted to be filled with an incompressible liquid, comprising: a pliable insert adapted to be received in the end of said tube, and a tubular metal sleeve surrounding and swaged onto said tube end, said tube being tightly clamped between said sleeve and said insert to seal against the escape of said liquid from said tube.

12. The end closure of claim 10 wherein an inner end of said insert protrudes inwardly into said tube beyond the inner end of said sleeve.

13. The end closure of claim 11 wherein an outer end of said insert protrudes outwardly beyond the end of said tube, and wherein said sleeve is swaged onto the protruding outer end of said insert.

* * * * *